US009119997B2

(12) United States Patent
Imamoto

(10) Patent No.: US 9,119,997 B2
(45) Date of Patent: Sep. 1, 2015

(54) FERRULE AND GOLF CLUB

(75) Inventor: Yasunori Imamoto, Tokyo (JP)

(73) Assignee: BRIDGESTONE SPORTS CO., LTD, Tokyo (JP)

( * ) Notice: Subject to any disclaimer, the term of this patent is extended or adjusted under 35 U.S.C. 154(b) by 189 days.

(21) Appl. No.: 13/611,246

(22) Filed: Sep. 12, 2012

(65) Prior Publication Data

US 2013/0137529 A1 May 30, 2013

(30) Foreign Application Priority Data

Nov. 30, 2011 (JP) ..... 2011-262364

(51) Int. Cl.
*A63B 53/02* (2015.01)

(52) U.S. Cl.
CPC ..... *A63B 53/02* (2013.01)

(58) Field of Classification Search
CPC ..... A63B 53/02
USPC ..... 473/305, 308–310
See application file for complete search history.

(56) References Cited

U.S. PATENT DOCUMENTS

| | | | | | |
|---|---|---|---|---|---|
| 1,202,383 | A * | 10/1916 | Hardman | 473/309 |
| 1,844,812 | A * | 2/1932 | Thorpe | 473/308 |
| 5,335,909 | A | 8/1994 | Green, Jr. | |
| 5,452,890 | A | 9/1995 | Bingman | |
| 5,624,330 | A * | 4/1997 | Tsuchida | 473/308 |
| 5,688,188 | A * | 11/1997 | Chappell | 473/309 |
| 5,910,056 | A * | 6/1999 | Nagamoto et al. | 473/305 |
| 6,352,482 | B1 * | 3/2002 | Jacobson et al. | 473/310 |
| 7,029,402 | B2 | 4/2006 | Nakajima | |
| 7,207,897 | B2 | 4/2007 | Burch et al. | |
| 8,133,132 | B2 * | 3/2012 | Takeuchi | 473/309 |
| 8,167,736 | B2 * | 5/2012 | Vald'Via et al. | 473/309 |
| 8,535,172 | B2 * | 9/2013 | O'Shea et al. | 473/305 |
| 2005/0096148 | A1 * | 5/2005 | Noble et al. | 473/305 |
| 2011/0319187 | A1 * | 12/2011 | Chou | 473/310 |
| 2012/0034996 | A1 * | 2/2012 | Murphy et al. | 473/307 |

FOREIGN PATENT DOCUMENTS

| | | | |
|---|---|---|---|
| JP | 08117364 | A | 5/1996 |
| JP | 2515800 | Y2 | 8/1996 |
| JP | 11076470 | A | 3/1999 |
| JP | 2000042146 | A | 2/2000 |
| JP | 2000140162 | A | 5/2000 |
| JP | 2002177417 | A | 6/2002 |
| JP | 2003093552 | A | 4/2003 |
| JP | 2006158477 | A | 6/2006 |
| JP | 2006158496 | A | 6/2006 |
| JP | 2008212454 | A | 9/2008 |
| JP | 2008264345 | A | 11/2008 |
| JP | 2009291353 | A | 12/2009 |
| JP | 2010125139 | A | 6/2010 |
| JP | 2010246595 | A | 11/2010 |

* cited by examiner

*Primary Examiner* — Stephen Blau
(74) *Attorney, Agent, or Firm* — Sughrue Mion, PLLC

(57) ABSTRACT

A ferrule includes: an upper body which projects from an upper end face of a hosel portion; an inserted portion which is provided to project downwards from the upper body to be inserted into an interior of a hosel hole; and a groove which is provided circumferentially on an outer circumferential surface of the inserted portion, wherein a lower end portion of the inserted portion has a diameter which is smaller than that of an upper side of the inserted portion than the groove.

8 Claims, 4 Drawing Sheets

FERRULE AND GOLF CLUB

BACKGROUND

1. Field of the Invention

The present invention relates to a ferrule which is used for a golf club and more particularly to a ferrule in which a groove is provided on an outer circumferential surface of a portion thereof which is inserted into a hosel hole. Additionally, the invention relates to a golf club which employs this ferrule.

2. Description of the Related Art

In a golf club in which a shaft is inserted into a hosel hole in a head of the golf club and is then fixed in place therein with an adhesive, a ferrule is fitted on the shaft, and the ferrule is disposed on an upper end face of a hosel portion in abutment therewith. An inserted portion adapted to enter an upper end portion of the hosel hole is provided on this ferrule (Japanese Utility Model Registration No. 2515800, JP-A-2000-42146 and JP-A-8-117364). Stress is generated near the upper end portion of the hosel hole of the shaft when a golf ball is hit and this stress is mitigated by providing the ferrule. In addition, the aesthetic appearance of the golf club is also improved by providing the ferrule.

This ferrule is fixed in place relative to the hosel hole with the adhesive. Japanese Utility Model Registration No. 2515800 and JP-A-2000-42146 describe a technique in which a groove is provided on an outer circumferential surface of the inserted portion so that part of the adhesive interposed between an inner circumferential surface of the hosel hole and the ferrule is accommodated in the groove, whereby the bonding strength of the ferrule to the hosel hole is enhanced.

When mounting the shaft in the hosel hole in the head of the golf club, the ferrule is fitted on the shaft in advance, and the adhesive is applied to a distal end portion of the shaft. Then, the shaft is inserted into the hosel hole, and the inserted portion of the ferrule is also inserted into the hosel hole. The surplus of the adhesive applied to the shaft enters a gap between the outer circumferential surface of the inserted portion of the ferrule and the inner circumferential surface of the hosel hole. When the groove is provided in the inserted portion, the adhesive is accommodated in the groove, whereby the bonding strength of the ferrule to the hose hole is enhanced.

SUMMARY

An object of the invention is to provided a ferrule which enables the smooth flow of an adhesive that is applied to a shaft into between an outer circumferential surface of an inserted portion of the ferrule and an inner circumferential surface of a hosel hole so as to facilitate the mounting work of the ferrule and a golf club which employs this ferrule.

According to an aspect of the invention, there is provided a ferrule including an upper body which projects from an upper end face of a hosel portion, an inserted portion which is provided to project downwards from the upper body to be inserted into an interior of a hosel hole and a groove which is provided circumferentially on an outer circumferential surface of the inserted portion, wherein a lower end portion of the inserted portion has a diameter which is smaller than that of an upper side of the inserted portion than the groove.

According to another aspect of the invention, a lower end side of the inserted portion than the groove has an isodiametric cylindrical shape.

According to a further aspect of the invention, at least the lower end portion of the inserted portion is tapered so as to reduce the diameter as it extends towards a lower end.

In a golf club of the invention, a shaft is mounted in a hosel hole in a head, and the ferrule of the invention is mounted thereon.

The hosel hole is preferably formed into a small diameter hole portion on a deeper side and into a large diameter hole portion on an entrance side, and a step portion is preferably provided between the small diameter hole portion and the large diameter hole portion, the step portion being preferably shaped so as to expand diametrically as it extends towards the entrance side.

In the ferrule of the invention, the lower end portion of the inserted portion has the diameter which is smaller than that of the upper side of the inserted portion than the groove, and therefore, when inserting the shaft into the hosel hole, the surplus of the adhesive easily flows into between the outer circumferential surface of the lower end portion of the inserted portion and the inner circumferential surface of the hosel hole. Because of this, the mounting work of the ferrule becomes easy. In addition, the adhesive is allowed to flow uniformly between the outer circumferential surface of the inserted portion and the inner circumferential surface of the hosel hole, whereby a bonding strength distribution in a circumferential direction of the inserted portion becomes uniform. Additionally, the groove is provided on the inserted portion, and therefore, the boding strength between the ferrule and the inner circumferential surface of the hosel hole is increased.

In the golf club of the invention, the step portion between the large diameter hole portion and the small diameter hole portion of the hosel hole is shaped so as to expand diametrically as it extends towards the entrance side (the upper side), whereby the surplus of the adhesive is made to flow upwards easily.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Figure 1:
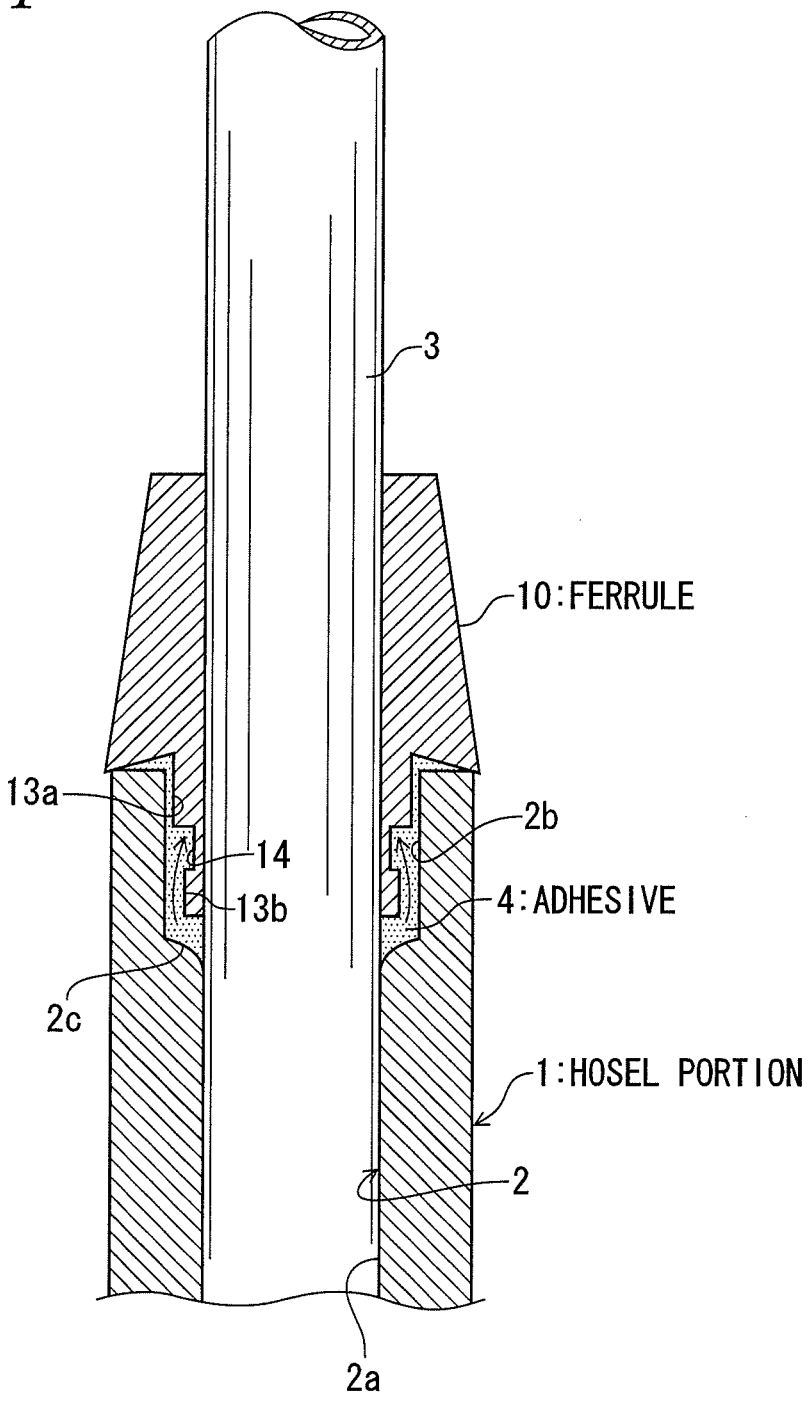
FIG. 1 is a sectional portion of a hosel portion of a golf club which includes a ferrule according to a first embodiment.

Hereinafter, a first embodiment will be described by reference to FIGS. 1, 2.

A shaft 3 is inserted into a hose hole 2 in a hosel portion 1 of a head of a golf club and is bonded in place therein with an adhesive 4. A ferrule 10, which is made of a cellulose nitrate plastic, is fitted on the shaft 3, and this ferrule 10 is also bonded in the hosel portion 1 with the adhesive 4. The hosel hole 2 includes a small diameter hole portion 2*a* situated on a deeper side, a large diameter hole portion 2*b* situated on an entrance side and a step portion 2*c* situated between both the hole portions. The step portion 2*c* has an inner circumferential edge having an arc-like shape in section and is expanded diametrically as it extends upwards.

Figure 2:
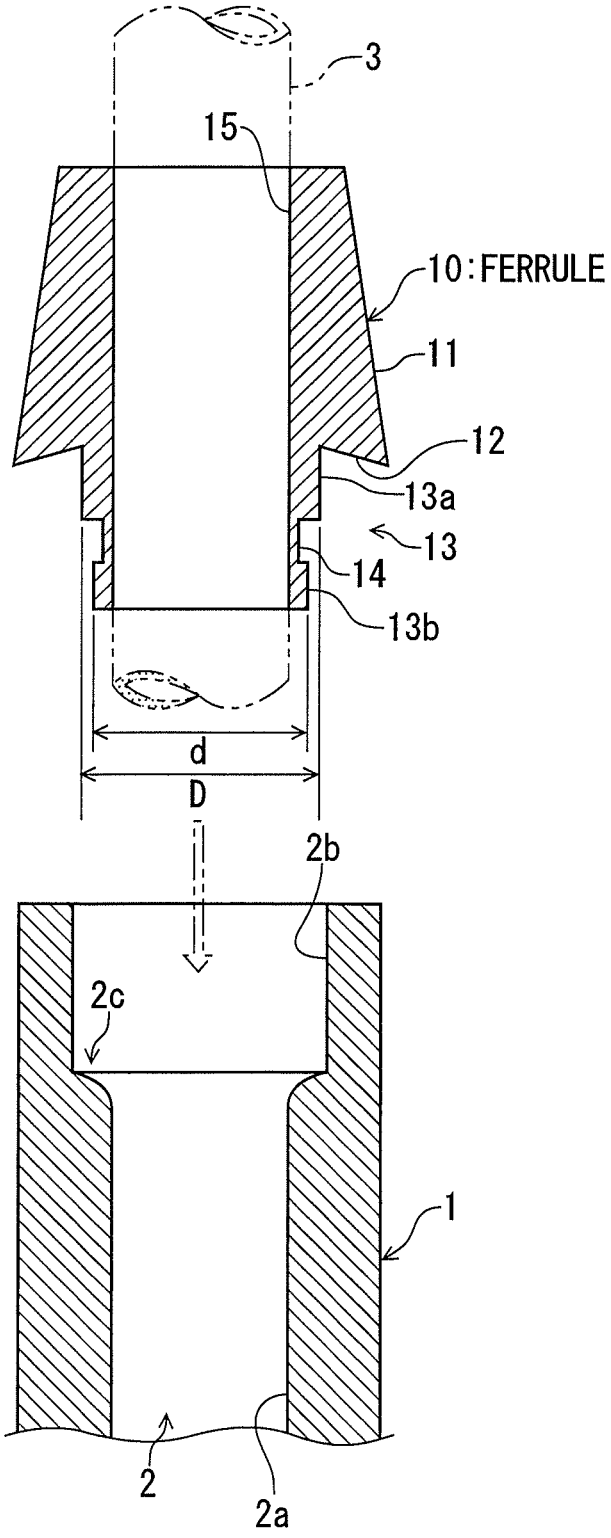
FIG. 2 is an exploded view of FIG. 1.

As shown in FIG. 2, the ferrule 10 has an upper body 11, a diametrically reduced surface 12 which is reduced diametrically in a centripetal direction from a lower end of the upper body 11, an inserted portion 13 which is provided to project downwards from the upper body 11, a groove 14 which is provided circumferentially on an outer circumferential surface of the inserted portion 13, and a shaft insertion hole 15 which penetrates an axial portion of the ferrule 10. The upper body 11 has a shape of substantially frustum of circular cone which is reduced in diameter as it extends upwards. A diameter at the lower end of the upper body 11 is made slightly larger than a diameter at an upper end of the hosel portion 1. The diametrically reduced surface 12 is tapered upwards so that a central portion takes an upper position.

In the outer circumferential surface of the inserted portion 13, an upper side than the groove 14 is made into an upper outer circumferential surface 13*a* which connects to an inner circumferential end of the diametrically reduced surface 12, and a lower side than the groove 14 is made into a lower outer circumferential surface 13*b*. Both the upper outer circumferential surface 13*a* and the lower outer circumferential surface 13*b* have a cylindrical shape. A diameter d of the lower outer circumferential surface 13*b* is smaller substantially by 0.1 to 0.5 mm and particularly 0.2 to 0.3 mm than a diameter D of the upper outer circumferential surface 13*a*.

To mount the shaft 3 and the ferrule 10 in the hosel portion 1, firstly, the ferrule 10 is fitted on the shaft 3, and thereafter, the adhesive 4 is applied to a distal end portion of the shaft 3, and the shaft 3 is then inserted into the hosel hole 2. When the shaft 3 is inserted into the small diameter hole portion 2*a* of the hosel hole 2, the surplus of the adhesive 4 moves towards the large diameter hole portion 2*b*. As the inserted portion 13 of the ferrule 10 comes to be inserted into the large diameter hole portion 2*b*, the surplus of the adhesive 4 flows into between the outer circumferential surface of the inserted portion 13 and the large diameter hole portion 2*b*, and part of the adhesive surplus enters the groove 14. The inserted portion 13 is inserted into the hosel hole 2 until the diametrically reduced surface 12 of the ferrule 10 is brought into abutment with an upper end face of the hosel portion 1. There may be such a situation that part of the surplus of the adhesive enters between the diametrically reduced surface 12 and the upper end face of the hosel portion 1. Thereafter, the adhesive is set, so that the shaft 3 and the ferrule 10 are fixedly bonded to the hosel portion 1.

Thereafter, an outer circumferential surface of the ferrule 10 is ground, so that the outer circumferential surface of the ferrule 10 connects to an outer circumferential surface of the hosel portion 1. Additionally, a solvent is applied to the outer circumferential surface of the ferrule 10 as required so as to make the outer circumferential surface of the ferrule 10 smooth.

In this ferrule 10, the lower outer circumferential surface 13*b* is smaller in diameter than the upper outer circumferential surface 13*a*, and a gap between the lower outer circumferential surface 13*b* and an inner circumferential surface of the large diameter hole portion 2*b* of the hosel hole 2 is relatively wide. Therefore, the adhesive 4 which rises from the small diameter hole portion 2*a* side is allowed to flow smoothly between the lower outer circumferential surface 13*b* and the inner circumferential surface of the large diameter hole portion 2*b*. In particular, in this embodiment, an inner circumferential edge of the step portion 2*c* has an arc-like shape in section, and therefore, the adhesive 4 which rises from the small diameter hole portion 2*a* side is allowed to pass smoothly between the step portion 2*c* and an outer circumferential edge of a lower end of the inserted portion 13. Because of this, the mounting work of the shaft 3 and the ferrule 10 can be implemented well.

In addition, the surplus of the adhesive which rises from the small diameter hole portion 2*a* side is allowed to flow uniformly in a circumferential direction between the inserted portion 13 and the inner circumferential surface of the large diameter hole portion 2*b* of the inserted portion 13. Therefore, the bonding strength becomes uniform in the circumferential direction. Additionally, a sufficient amount of adhesive 4 is accommodated in the groove 14, and therefore, the bonding strength between the inserted portion 13 and the hosel portion 1 also becomes high.

Ferrules 10A, 10B according to second and third embodiments will be described by reference to FIGS. 3, 4, respectively.

Figure 3:
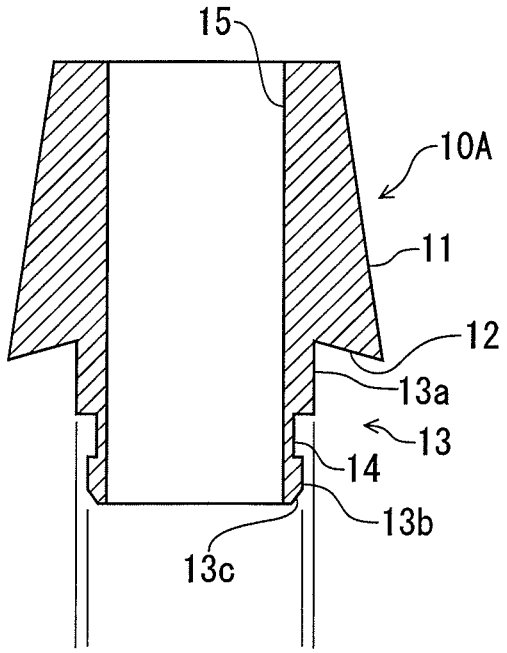
FIG. 3 is a sectional view of a ferrule according to a second embodiment.

In the ferrule 10A shown in FIG. 3, a diameter of a lower outer circumferential surface 13*b* is smaller than a diameter of an upper outer circumferential surface 13*a* of an inserted portion 13. Further, a chamfered or tapered portion 13*c* is provided along a lower edge of the lower circumferential surface 13*b*. Since the diameter of the lower outer circumferential surface 13*b* is smaller than the diameter of the upper outer circumferential surface 13*a* and the tapered portion 13*c* is provided, the surplus of an adhesive which rises from a small diameter hole portion 2*a* is allowed to flow upwards smoothly.

Figure 4:
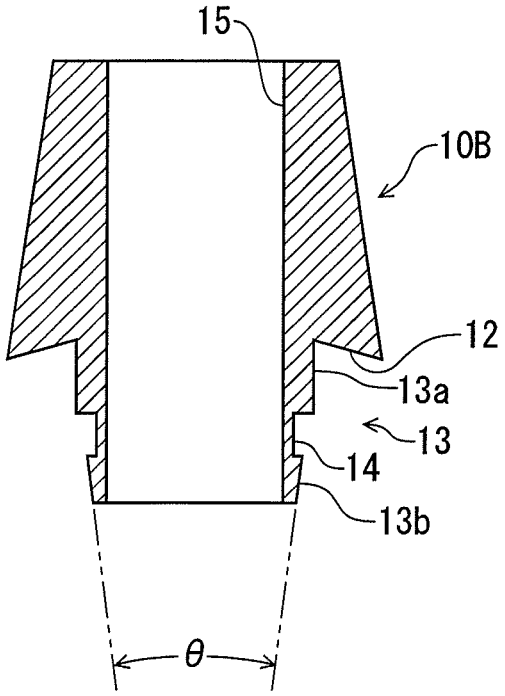
FIG. 4 is a sectional view of a ferrule according to a third embodiment.

In the ferrule 10B shown in FIG. 4, an upper outer circumferential surface 13*a* and a lower outer circumferential surface 13*b* of an inserted portion 13 are made into tapered surfaces of a tapered angle θ which are reduced in diameter as they extend downwards. In this way, the inserted portion 13 excluding a groove 14 is formed into a tapered shape which is tapered as it extends downwards, whereby the surplus of an adhesive which rises from a small diameter hole portion 2*a* is allowed to flow upwards smoothly.

Any of the embodiments constitutes an example of the invention, and the invention may be given configurations other than those illustrated in the accompanying drawings. For example, in the ferrule 10A in FIG. 3, the whole of the lower outer circumferential surface 13*b* may be formed into a tapered surface which is tapered as it extends downwards.

Two or more grooves 14 may be provided in this invention. In this invention, part of the ferrule may be made of metal.

What is claimed is:

1. A ferrule and a hosel for a golf club comprising:

a hosel; and a ferrule, wherein the ferrule comprises:

an upper body which projects from an upper end face of said hosel;

a diametrically reduced surface tapered upwards so that a central portion takes an upper position;

an inserted portion which is provided to project downwards from the upper body to be inserted into an interior of a hole in said hosel; and a groove which is provided circumferentially on an outer circumferential surface of the inserted portion, wherein:

a lower end portion of the inserted portion has a diameter which is smaller than that of an upper side of the inserted portion above the groove;

the diametrically reduced surface is disposed between a lower end of the upper body and the inserted portion; and a space is formed between the diametrically reduced surface and an upper end of said hosel.

2. The ferrule and hosel according to claim 1, wherein a lower end side of the inserted portion below the groove has an isodiametric cylindrical shape.

3. The ferrule and hosel according to claim 2, wherein a diameter of a lower outer circumferential surface of the inserted portion is smaller by 0.1 to 0.5 mm than a diameter of an upper outer circumferential surface of the inserted portion.

4. The ferrule and hosel according to claim 1, wherein at least the lower end portion of the inserted portion is tapered so as to reduce the diameter as it extends towards a lower end.

5. A golf club comprising:

a head including a hosel hole;

a shaft mounted in the hosel hole; and a ferrule including:

an upper body which projects from an upper end face of a hosel portion of the head;

a diametrically reduced surface tapered upwards so that a central portion takes an upper position;

an inserted portion which is provided to project downwards from the upper body to thereby be inserted into an interior of the hosel hole; and a groove which is provided circumferentially on an outer circumferential surface of the inserted portion, wherein a lower end portion of the inserted portion has a diameter which is smaller than that of an upper side of the inserted portion above the groove;

the diametrically reduced surface is disposed between a lower end of the upper body and the inserted portion; and a space is formed between the diametrically reduced surface and an upper end of the hosel portion.

6. The golf club according to claim 5, wherein:

the hosel hole is formed into a small diameter hole portion on a deeper side and into a large diameter hole portion on an entrance side, and a step portion is provided between the small diameter hole portion and the large diameter hole portion; and the step portion is shaped so as to expand diametrically as it extends towards the entrance side.

7. The golf club according to claim 6, wherein:

an adhesive flows into between the outer circumferential surface of the inserted portion and the large diameter hole portion;

a part of the adhesive enters the groove; and the adhesive is set so that the shaft and the ferrule are fixedly bonded to the hosel portion.

8. The golf club according to claim 6, wherein:

an inner circumferential edge of the step portion has an arc shape in cross-section.

* * * * *